US005265356A

United States Patent [19]

Winter

[11] Patent Number: 5,265,356

[45] Date of Patent: Nov. 30, 1993

[54] SNOWPLOW AND HYDRAULIC SYSTEM FOR SAME

[76] Inventor: Kent L. Winter, P.O. Box 463, Willoughby, Ohio 44094

[21] Appl. No.: 960,724

[22] Filed: Oct. 14, 1992

[51] Int. Cl.[5] ..... E01H 5/00

[52] U.S. Cl. ..... 37/234; 37/232; 37/236; 37/266

[58] Field of Search ..... 37/232, 233, 234, 235, 37/236, DIG. 11, 266

[56] References Cited

U.S. PATENT DOCUMENTS

| | | | |
|---|---|---|---|
| 3,706,144 | 12/1972 | Miceli | 37/234 |
| 4,028,820 | 6/1977 | Simonds, Jr. | 37/234 |
| 4,074,448 | 2/1978 | Niemala | 37/232 X |
| 4,258,484 | 3/1981 | Lansard | 37/234 X |

FOREIGN PATENT DOCUMENTS

| | | | |
|---|---|---|---|
| 2-47413 | 2/1990 | Japan | 37/234 |

*Primary Examiner*—Randolph A. Reese
*Assistant Examiner*—Arlen L. Olsen
*Attorney, Agent, or Firm*—Watts, Hoffmann, Fisher & Heinke Co.

[57] ABSTRACT

A hydraulic system for a hydraulic-piston-lifted snowplow adapted to scrape a surface (e.g., a snowplow for scraping snow and ice off pavements) is shown. To save unnecessary wear on the snowplow blade, the system can be operated to allow less than the full weight of the moldboard and blade to rest on the surface being scraped. In the operation of the plow, a fraction of the moldboard and blade weight selected, the magnitude of an instantaneous deviation therefrom is measured and converted into an electrical signal, and a servo-operated control valve is actuated in response to said signal for bypassing more or less hydraulic fluid away from piston in connection of the hydraulic lift given the moldboard and blade by the piston.

9 Claims, 1 Drawing Sheet

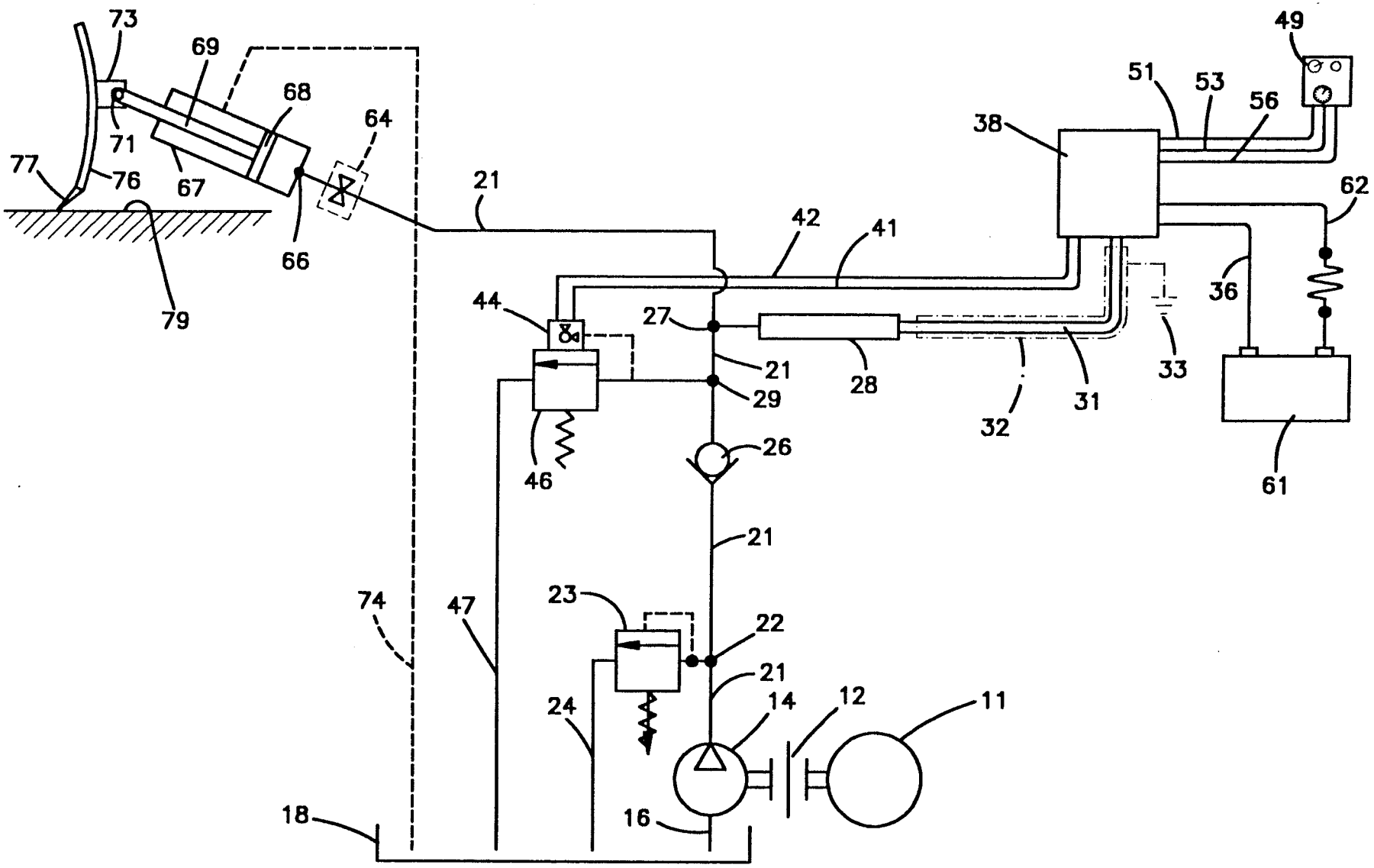
49
56
53
51
38
62
36
61
33
31
32
41
42
28
21
29
27
26
21
22
21
14
12
11
16
23
24
46
44
47
21
74
18
64
66
68
69
67
79
73
71
76
77

SNOWPLOW AND HYDRAULIC SYSTEM FOR SAME

TECHNICAL FIELD

The present invention relates to an improved snowplow and to a hydraulic system for the same.

BACKGROUND OF THE INVENTION

Snowplows for frontal mountings on road vehicles generally are raised by the movement of a hydraulically operated piston encased in a cylinder, the moldboard with a blade on a large highway snowplow may weigh as much as 1500 to 3000 pounds.

It has been proposed to equip snowplow moldboards and blades with force limiters which permit the blade and moldboard to move backward and upward for cleaning obstacles (U.S. Pat. No. 3,587,182), with blade-directing and tripping devices for snowplows (e.g., U.S. Pat. No. 3,893,578), and various runners, skids shoes or caster wheels for sensing a surface by contact and, in some cases, "planing" a snow covering on a road.

Also, in the road grader art, it has been proposed to regulate the depth of cut or scraping by use of a wave energy distance sensor, of the ground, the sensor being mounted on the equipment.

The weight of the snowplow moldboard equipped with a blade, together with the speeds at which the vehicle-mounted snowplows frequently operate, particularly large highway plows, often makes for much blade wear and necessitates frequent blade replacement. Eight to ten hours of rugged highway service has been known to wear out a snowplow blade.

The present invention provides a way for reducing such blade wear and extending the operating life of the blade. In essence, it is based on regulating the fraction of moldboard and blade weight that is supported by the surface being scraped e.g., highway pavement, at a value which is effective for scraping such as snow and/or ice removal from said surface but lower then the full weight of the moldboard and blade. Such value can be, say, about 10–90% of such full weight and move frequently about 20–40% with concomitant lessening of blade abrasion.

BROAD STATEMENT OF THE INVENTION

One aspect of this invention is an "improvement" in a snowplow for scraping a surface, such snowplow having a moldboard equipped with a blade, the moldboard being linked to a reciprocating piston encased in a hydraulic cylinder, the motion of the piston being effected by hydraulic fluid delivered by pump to the piston from reservoir means, the hydraulic fluid pump discharge passing through a pressure line and into contact with the piston by means of an access in the cylinder, the pressure line being equipped with a pressure relief valve connected thereto for discharging hydraulic fluid from the pressure line into the reservoir means during an overpressure condition on the pressure line.

The improvement is one for sustaining a preselected fraction of the moldboard and blade weight on the surface being scraped, and it comprises:

a check valve in the pressure line, said valve being disposed between the relief valve connection and said access, the check valve directing pumped hydraulic fluid away from the pump discharge;

means for setting said fraction, then detecting and responding to a deviation from such setting; and a control valve connected to the pressure line between the check valve and the access, said control valve being actuated by said means of setting, detecting and responding, the actuation being effective to bypass more or less hydraulic fluid from the pressure line to the reservoir means and sustain the preselected fraction of moldboard and blade weight on said surface.

Another aspect of this invention is a hydraulic system for sustaining a preselected fraction of snowplow moldboard and blade weight on paving being scraped thereby. The system comprises: a reservoir for hydraulic fluid; a pump taking hydraulic fluid suction from the reservoir and discharging it into a pressure line; the pressure line conducting said fluid to an access in a hydraulic cylinder encasing a piston that can provide lift to the plow blade and moldboard; relief valve means for returning hydraulic fluid from the pressure line to the reservoir during an overpressure condition in the pressure line; a check valve in the pressure line, the check valve being disposed between the relief valve connection and said access; the check valve directing fluid flow away from the pump; means for setting such fraction, then detecting and responding to a deviation from said preselected fraction of weight; and a control valve connected to the pressure line between the check valve and said access, said control valve being actuated by said means for setting, detecting and responding, the actuation being effective to bypass more or less hydraulic fluid from the pressure line to the reservoir and sustain the preselected fraction of mold board and blade weight on said paving.

BRIEF DESCRIPTION OF THE DRAWING

The drawing is a schematic diagram of a preferred embodiment of the system linked to a snowplow moldboard equipped with a blade that contacts a pavement being scraped.

BEST MODE FOR CARRYING OUT THE INVENTION

The apparatus depicted is adapted for mounting aboard a truck (not shown), typically one used for highway snow plowing, the moldboard and blade weight being about 2000 pounds. The blade is raised hydraulically and angled to one side or the other by a hydraulically activated screw turning device (means not shown).

Power takeoff 11 from the truck engine (not shown) drives pump 14 through clutch 12. Pump 14 takes hydraulic fluid (an oil) suction through line 16 and discharges it out line 21. Pressure relief valve 23 joins line 16 at connection 22. In the event of the fluid in line 21 reacting at an undesirable high pressure at which valve 23 is set, hydraulic fluid bleeds from line 16 through valve 23 and line 24 into reservoir 18. Reservoir 18, in reality, is an enclosed vessel, but is depicted conventionally here as a trough that receives various inlets of hydraulic fluid.

Check valve 26 prevents back flow of hydraulic fluid from beyond the position of valve 26 in line 21. The hydraulic fluid in line 21 passes through the shutoff valve 64. Valve 64 is closed when the truck is travelling. Valve 64 is operated from the dashboard (not shown) in the cab of the truck.

The hydraulic fluid enters hydraulic cylinder 67 through access aperture 66 to contact reciprocating piston 68. Piston 68 is attached to rod 69. Rod 69 is pivotally linked to arm 73 by means of pin 71. Arm 73 is fixed to snowplow moldboard 76 which has plowblade 77 at its base and in contact with pavement 79. No snow is shown.

An increase in the hydraulic pressure from line 21 against piston 68 tends to move rod 69, thus moldboard 76 and blade 77, upwardly, thus lifting some of the weight of items 76 and 77 off the pavement 79. Conversely, lowering such hydraulic pressure, e.g., by bleeding the cylinder into reservoir 18 tends to allow more of such weight to rest on pavement 79.

Transducer 28 is connected to line 21 to accept the hydraulic pressure from it. Transducer 28 converts such pressure to an electrical voltage signal. The signal is delivered by cable 31, cable 31 being equipped with electrical shielding 32 and grounding 33, to main power box 38. Box 38 contains a voltage amplifier circuit board, a feedback circuit 10 board and a summing circuit board (not shown). The electrical circuitry in box 38 is energized by direct current supplied by storage battery 61. The current flows to box 38 by electrical lead 36 and out of box 38 by electrical lead 62.

Electrical leads 51, 53 and 56, leading to the circuitry in Box 38, connect the Box 38 controls in control box 49 which is mounted on the dash of the truck cab. These controls are an on-and-off switch for electrical power. An electric light indicates power on or off, and a preselection dial for selecting what fraction of plow moldboard and blade weight is to be supported hydraulically or, conversely, what fraction of such weight is to be supported by the paving being scraped.

The electrical signal output from box 38 is delivered by leads 41 and 42 to the servo mechanism 44 that operates constantly to variably throttle the control valve 46.

The signal from lead 41 is responsive to the magnitude of the weight deviation above that preselected for the moldboard and blade, and the signal from lead 42 is responsive to the magnitude of the weight deviation below such preselected value.

More or less hydraulic fluid is flowing constantly through control valve 46 in a normal operation of the plow and bypasses cylinder 67 and piston 68. Fluid drains from valve 46 into the reservoir 18 by means of line 47, cylinder 67 is bled of fluid through line 74, shown as dotted (as this operation is occasional). The hydraulic system can be extended conventionally to operate a salt spreader on the same truck.

In place of transducer means such as transducer 28, a strain gauge can be used to measure the deflection of a pivotable support for the moldboard. In such instance, less deflection from a preset value, and the lesser electrical signal generated thereby is indicative of a greater fraction of moldboard and blade weight being borne by the road surface. Conversely, greater deflection from such preset value indicates the opposite. The magnitude of the deviation from such preset value determines the instant-to-instant degree of bypassing of hydraulic fluid in a control valve like valve 46 and the fraction of moldboard and blade resting on the pavement is sustained reasonably constant in the plowing operation. In many ways the moldboard and blade weight control here is analogous to the setting and operation of a cruise control on an automobile.

Many modifications and variations of the invention will be apparent to those skilled in the snowplow, hydraulic and electronic control arts in light of the foregoing disclosure and drawing. Therefore, it is to be understood that, within the scope of the appended claims, the invention can be practiced otherwise than has specifically been shown and described.

What is claimed is:

1. In a snowplow having a moldboard equipped with a blade, the moldboard being linked to a reciprocating piston encased in a hydraulic cylinder, the motion of the piston being effected by a hydraulic fluid delivered to a piston pump from reservoir means, a hydraulic fluid pump discharge passing through a pressure line and into contact with the piston by means of an access in the cylinder, the pressure line being equipped with a pressure relief valve connected thereto for discharging hydraulic fluid from the pressure line into the reservoir means during an overpressure condition in the pressure line, the improvement for maintaining a preselected fraction of the moldboard and blade weight on the surface being scraped which comprises:

a check valve in the pressure line, said check valve being disposed between the relief valve connection and said access, the check valve directing pumped hydraulic fluids away from a pump discharge;

means for setting said fraction, then detecting and responding to a deviation from the preselected fraction of the moldboard and blade weight; and a control valve connected to the pressure line between the check valve and the access, said control valve being actuated by said means for setting said fraction, then detecting and responding, the actuation being effective to bypass more or less hydraulic fluid from the pressure line to the reservoir means and sustain the preselected fraction of moldboard and blade weight on said surface.

2. The snowplow of claim 1 wherein the means for setting said fraction, then detecting and responding to a deviation from set value comprises transducer means adapted for generating an electrical signal that indicates a magnitude of an instantaneous hydraulic pressure against the piston and therefore the corresponding amount of hydraulic lift provided to the moldboard and blade weight supported by the surface being scraped.

3. The snowplow of claim 2 wherein the means for setting, then detecting and responding also includes means for amplifying the electrical signal from the transducer means, summing circuitry for sensing the degree of deviation from said preselected weight fraction, and feedback circuitry actuating the control valve for elimination of said deviation.

4. The snowplow of claim 1 wherein the means for setting said fraction, then detecting and responding to a deviation from the setting comprises strain gauge means adapted for generating an electrical signal that is proportional to the magnitude of the moldboard and blade weight supported by the surface being scraped.

5. The snowplow of claim 4 wherein the means for setting said fraction, then detecting and responding also includes means for amplifying the electrical signal from said strain gauge means, summing circuitry for sensing the degree of deviation from said preselected weight fraction, and feedback circuitry actuating the control valve for elimination of said deviation.

6. The snowplow of claim 4 wherein a strain gauge is disposed to measure the deflection of a pivotable support for the moldboard and blade, the deflection of said support being inversely proportional to the fraction of moldboard and blade weight that is supported by the surface being scraped.

7. A hydraulic system for a snowplow and moldboard for sustaining a preselected fraction of a snowplow moldboard and blade weight of a vehicle-mounted snowplow on pavement being scraped thereby, the system comprising:

a reservoir for hydraulic fluid;

a pump taking hydraulic fluid suction from the reservoir and discharging it into a pressure line, the pressure line conducting said fluid to an access in a hydraulic cylinder encasing a piston that can provide lift to the snowplow blade and moldboard;

relief valve means for returning hydraulic fluid from the pressure line to the reservoir during an overpressure condition in the pressure line;

a check valve in the pressure line, said check valve being disposed between the relief valve connection and said access, the check valve directing fluid flow away from the pump;

means for setting said fraction, then detecting and responding to a deviation from the preselected fraction of the moldboard and blade weight; and a control valve connected to the pressure line between the check valve and the access, said control valve being actuated by said means for setting said fraction, then detecting and responding, the actuation being effective to bypass more or less hydraulic fluid from the pressure line to the reservoir and sustain the preselected fraction of moldboard and blade weight on said paving.

8. The hydraulic system of claim 7 wherein said means for setting said fraction, then detecting and responding comprises transducer means adapted for generating an electrical signal that indicates the magnitude of the instantaneous hydraulic pressure against the piston and, therefore, the corresponding amount of hydraulic lift provided to the moldboard and blade relative to the moldboard and blade weight to be supported by the pavement.

9. The hydraulic system of claim 7 wherein the means for setting said fraction, then detecting and responding to a deviation from the preselected fraction of moldboard and blade weight comprises strain gauge means adapted for generating an electrical signal that is proportional to the magnitude of the moldboard and blade weight supported by the surface being scraped.

* * * * *